US009444144B2

(12) United States Patent
Cheng et al.

(10) Patent No.: US 9,444,144 B2
(45) Date of Patent: Sep. 13, 2016

(54) ELECTRONIC DEVICE

(71) Applicants: Tsung-Han Cheng, Taipei (TW); Liang-Jen Lin, Taipei (TW); Hung-Chieh Wu, Taipei (TW)

(72) Inventors: Tsung-Han Cheng, Taipei (TW); Liang-Jen Lin, Taipei (TW); Hung-Chieh Wu, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 272 days.

(21) Appl. No.: 14/153,101

(22) Filed: Jan. 13, 2014

(65) Prior Publication Data

US 2014/0198010 A1 Jul. 17, 2014

Related U.S. Application Data

(60) Provisional application No. 61/753,439, filed on Jan. 17, 2013.

(30) Foreign Application Priority Data

Dec. 9, 2013 (TW) ..... 102145212 A

(51) Int. Cl.

| | |
|---|---|
| ***H01Q 1/24*** | (2006.01) |
| ***H01Q 7/00*** | (2006.01) |
| ***H01Q 1/22*** | (2006.01) |
| ***H01Q 1/52*** | (2006.01) |
| ***H01Q 21/28*** | (2006.01) |

(52) U.S. Cl.

CPC ..... *H01Q 7/00* (2013.01); *H01Q 1/2208* (2013.01); *H01Q 1/243* (2013.01); *H01Q 1/521* (2013.01); *H01Q 21/28* (2013.01)

(58) Field of Classification Search

CPC ..... H01Q 7/00; H01Q 1/2208; H01Q 21/28; H01Q 1/521; H01Q 1/243

USPC ..... 343/702, 833, 872, 873; 455/41.1, 41.2

See application file for complete search history.

(56) References Cited

U.S. PATENT DOCUMENTS

| | | | | |
|---|---|---|---|---|
| 6,667,719 | B2 * | 12/2003 | LaKomski | H01Q 1/241 343/700 MS |
| 7,768,462 | B2 * | 8/2010 | Zhang | H01Q 1/243 343/702 |
| 8,736,495 | B2 * | 5/2014 | Cho | G06K 19/0723 343/702 |
| 2006/0159158 | A1 * | 7/2006 | Moore | G06F 1/1632 375/130 |
| 2012/0032858 | A1 | 2/2012 | Chang et al. | |

FOREIGN PATENT DOCUMENTS

| | | |
|---|---|---|
| CN | 2006136212 | 1/2008 |

* cited by examiner

*Primary Examiner* — Michael C Wimer
(74) *Attorney, Agent, or Firm* — Jianq Chyun IP Office

(57) ABSTRACT

An electronic device is provided. The electronic device includes a conductive housing, a first antenna element, a second antenna element and an insulation structure. The first antenna element is disposed in the conductive housing. The second antenna element is disposed on an external surface of the conductive housing and is opposite to the first antenna element. The conductive housing generates a first current in response to the operation of the second antenna element. The insulation structure penetrates through the conductive housing and extends from at least one side of the conductive housing to the second antenna element. The conductive housing generates an induction current in response to the operation of the first antenna element. The insulation structure blocks the induction current so that the conductive housing generates a second current, and a direction of the first current is the same as a direction of the second current.

9 Claims, 4 Drawing Sheets

ELECTRONIC DEVICE

CROSS-REFERENCE TO RELATED APPLICATION

This application claims the priority benefit of U.S. provisional application Ser. No. 61/753,439, filed on Jan. 17, 2013 and TW application serial No. 102145212, filed on Dec. 9, 2013. The entirety of each of the above-mentioned patent applications is hereby incorporated by reference herein and made a part of this specification.

BACKGROUND OF THE INVENTION

1. Field of the Invention

The invention relates to an electronic device and, more particularly, to an electronic device with an antenna element.

2. Description of the Related Art

Nowadays, besides various functions, the appearance of electronic devices becomes even more important. For example, a metal housing and a nameplate are used to improve the appearance and more stylish. However, a near-field communication (NFC) antenna disposed at the surface of the metal housing is usually affected by a metal shielding effect, and thus the communication quality of the NFC antenna is poor.

BRIEF SUMMARY OF THE INVENTION

An electronic device is provided. The electronic device uses an insulation structure to generate second current, and uses the second current to improve the communication quality of a second antenna element. Thus, the affection from a conductive element and a conductive housing on the second antenna element is reduced.

An electronic device includes a conductive housing, a first antenna element, a second antenna element and an insulation structure. The first antenna element is disposed in the conductive housing. The second antenna element is disposed at the external surface of the conductive housing and is opposite to the first antenna element. The conductive housing generates first current in response to the operation of the second antenna element. The insulation structure penetrates through the conductive housing and extends from at least one side of the conductive housing to the second antenna element. The conductive housing generates induction current in response to the operation of the first antenna element, and the insulation structure blocks the induction current to make the conductive housing generate second current. A direction of the first current is the same as a direction of the second current.

As stated above, the insulation structure penetrates through the conductive housing and extends from at least one side of the conductive housing to the second antenna element. Under the block of the insulation structure, the induction current generated in the conductive housing in response to the operation of the first antenna element is converted to the second current whose direction is the same as that of the first current. Moreover, the second current can help increasing magnetic flux of the second antenna element, and reduce the affection from the conductive element and the conductive housing on the second antenna element.

These and other features, aspects and advantages of the present invention will become better understood with regard to the following description, appended claims, and accompanying drawings.

DETAILED DESCRIPTION OF THE EMBODIMENTS

Figure 1:
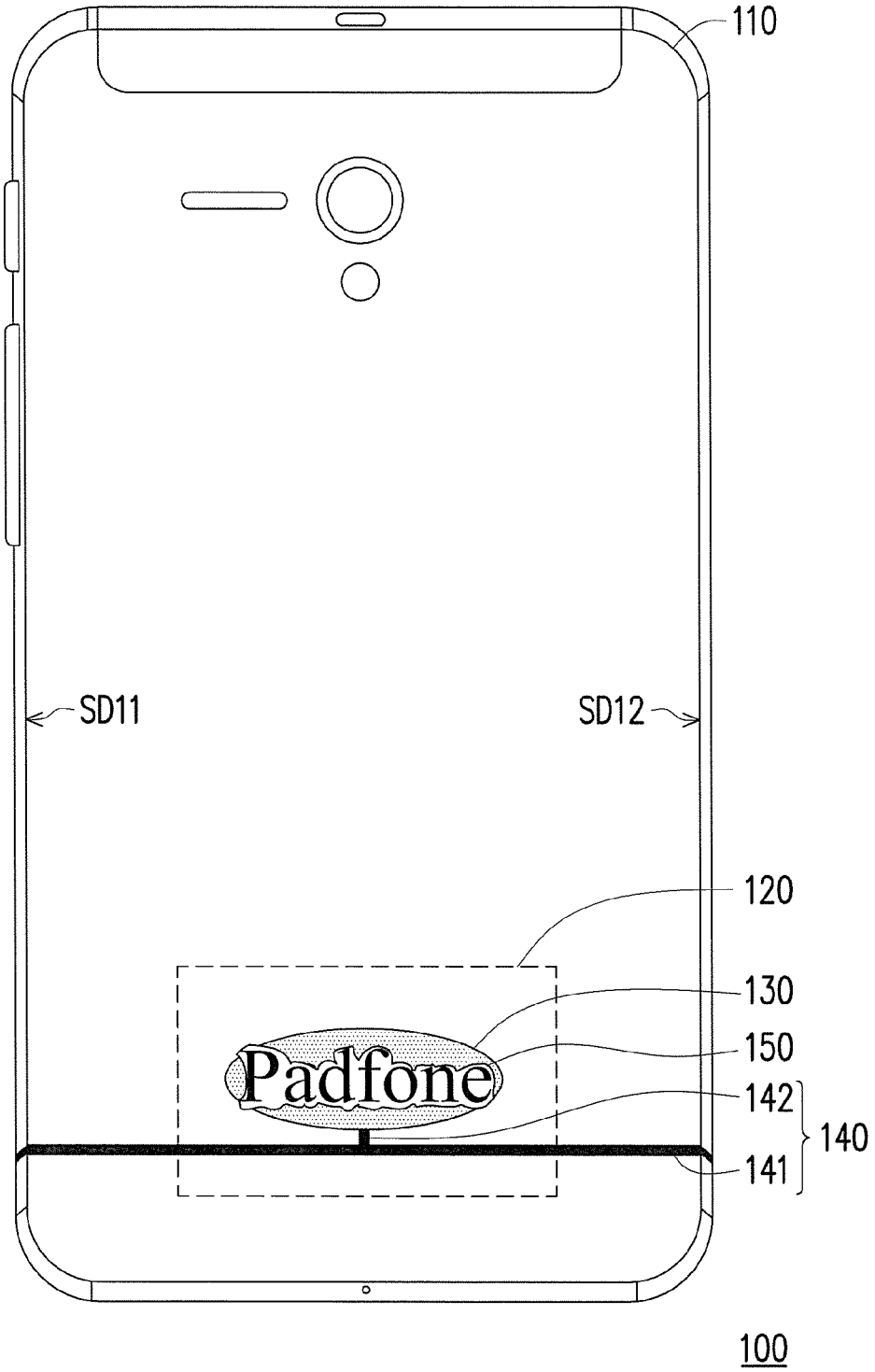
FIG. 1 is a schematic diagram showing an electronic device in an embodiment.

FIG. 1 is a schematic diagram showing an electronic device in an embodiment. Please refer to FIG. 1, the electronic device 100 includes a conductive housing 110, a first antenna element 120, a second antenna element 130, an insulation structure 140 and a conductive element 150.

The first antenna element 120 is disposed in the conductive housing 110. For example, the conductive housing 110 has an accommodating space, and the first antenna element 120 is disposed in the accommodating space. The first antenna element 120 may be a coil antenna, and receives a feeding signal from a transceiver (not shown) of the electronic device 100. When the first antenna element 120 (such as a coil antenna) is triggered by the feeding signal, it generates an alternating magnetic field.

The second antenna element 130 is disposed at the external surface of the conductive housing 110, and the second antenna element 130 is electrically insulated from the external surface of the conductive housing 110. For example, an insulation layer is disposed between the second antenna element 130 and the conductive housing 110. Moreover, the second antenna element 130 is opposite to the first antenna element 120 across the conductive housing 110, and the second antenna element 130 is close to the insulation structure 140. In other words, the conductive housing 110 is located between the first antenna element 120 and the second antenna element 130, and an orthogonal projection of the first antenna element 120 on the conductive housing 110 is overlapped with an orthogonal projection of the second antenna element 130 on the conductive housing 110. The second antenna element 130 is used as an NFC antenna, and guides the alternating magnetic field generated by the first antenna element 120. Thus, the electronic device 100 can transmit information via the alternating magnetic field. Relatively, the conductive housing 110 generates the first current in response of the operation of the second antenna element 130.

The insulation structure 140 penetrates through the conductive housing 110, and extends from at least one side of the conductive housing 110 to the second antenna element 130. For example, at least one side of the conductive housing 110 includes a first side SD11 and a second side SD12, and the first side SD11 is opposite to the second side SD12. Furthermore, the insulation structure 140 extends from the first side SD11 and the second side SD12 to the second antenna element 130, respectively, and the insulation structure 140 intersects with the first side SD11 and the first side SD12 of the conductive housing 110. That is, the insulation structure 140 cuts the first side SD11 and the first side SD12 of the conductive housing 110.

In the embodiment in FIG. 1, the insulation structure 140 may be T-shaped, and the insulation structure 140 includes a first insulation wire 141 and a second insulation wire 142. In the whole configuration, the first insulation wire 141 extends from the first side SD11 to the second side SD12 and intersects with the first side SD11 and the second side SD12. The second insulation wire 142 is perpendicular to the first insulation wire 141. Moreover, a first end of the second insulation wire 142 is connected to the first insulation wire 141, and a second end of the second insulation wire 142 is close to the second antenna element 130.

The alternating magnetic field generated by the first antenna element 120 may make the conductive housing 110 generate the induction current. In other words, the conductive housing 110 also generates the induction current in response to the operation of the first antenna element 120. The insulation structure 140 which penetrates through the conductive housing 110 blocks the induction current generated in the conductive housing 110, and makes the conductive housing 110 generate the second current. A direction of the first current is the same as a direction of the second current.

Figure 2:
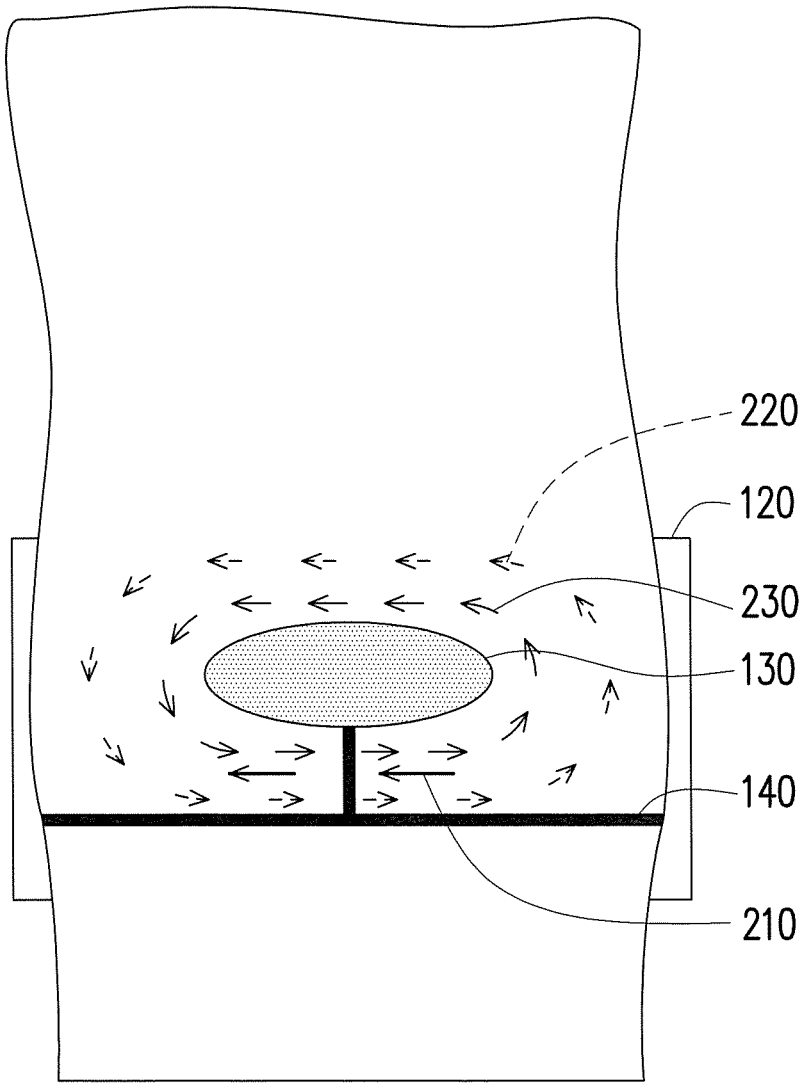
FIG. 2 is a partial schematic diagram showing the electronic device in FIG. 1.

For example, FIG. 2 is a partial schematic diagram showing the electronic device in FIG. 1. As shown in FIG. 2, the conductive housing 110 generates the induction current 210 in the alternating magnetic field of the first antenna element 120. Under the block of the insulation structure 140, the induction current 210 guides the second current 220. On the other hands, the conductive housing 110 also generates the first current 230 in response to the operation of the second antenna element 130. The direction of the second current 220 is the same as the direction of the first current 230. Consequently, the second current 220 helps increasing the magnetic flux of the second antenna element 130 (which is an NFC antenna), and improves the communication quality of the second antenna element 130.

As shown in FIG. 1, the conductive element 150 covers the second antenna element 130. The conductive element 150 is electrically insulated from the second antenna element 130. For example, another insulation layer is disposed between the conductive element 150 and the second antenna element 130. Moreover, the conductive element 150 may be a logo or a metal nameplate of the electronic device. The second current can improve the communication quality of the second antenna element 130, and reduce a metal shielding effect from the conductive element 150 and the conductive housing 110 on the second antenna element 130.

In other words, under the block of the insulation structure 140, the induction current generated in the conductive housing 110 in response to the operation of the first antenna element 120 would be converted to the second current whose direction is the same as that of the first current. Thus, the second current helps increasing the magnetic flux of the second antenna element 130 (which is an NFC antenna), improves the communication quality of the second antenna element 130, and reduces the affection from the conductive element 150 and the conductive housing 110 on the second antenna element 130.

Figure 3:
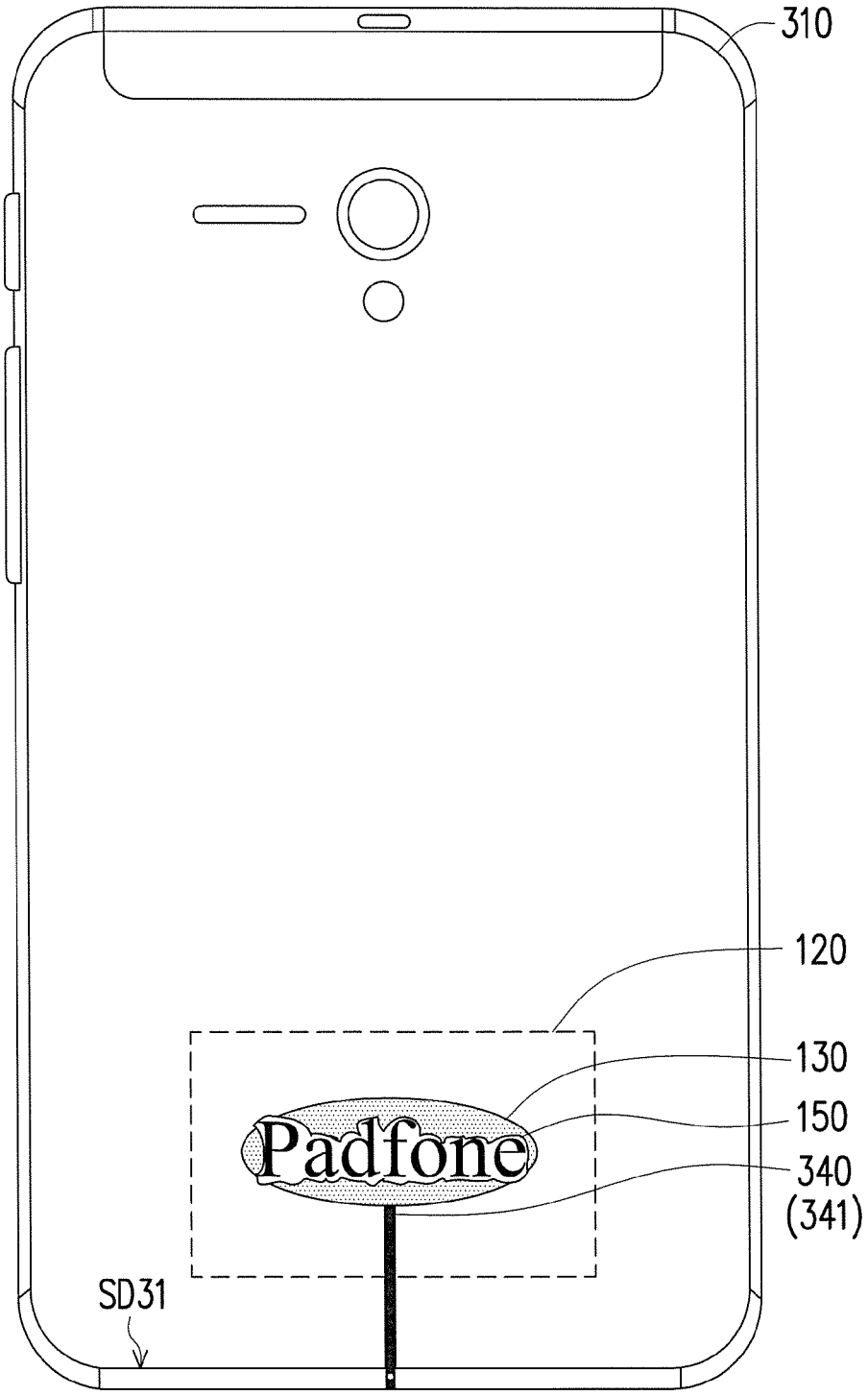
FIG. 3 is a schematic diagram showing an electronic device in another embodiment.

The insulation structure 140 in FIG. 1 is not limited to the embodiment. For example, FIG. 3 is a schematic diagram showing an electronic device in another embodiment. The electronic device 300 in FIG. 3 is similar with the electronic device 100 in FIG. 1. Moreover, the difference therebetween is that at least one side of the conductive housing 310 is including the first side SD31, and the insulation structure 340 is line-shaped.

Figure 4:
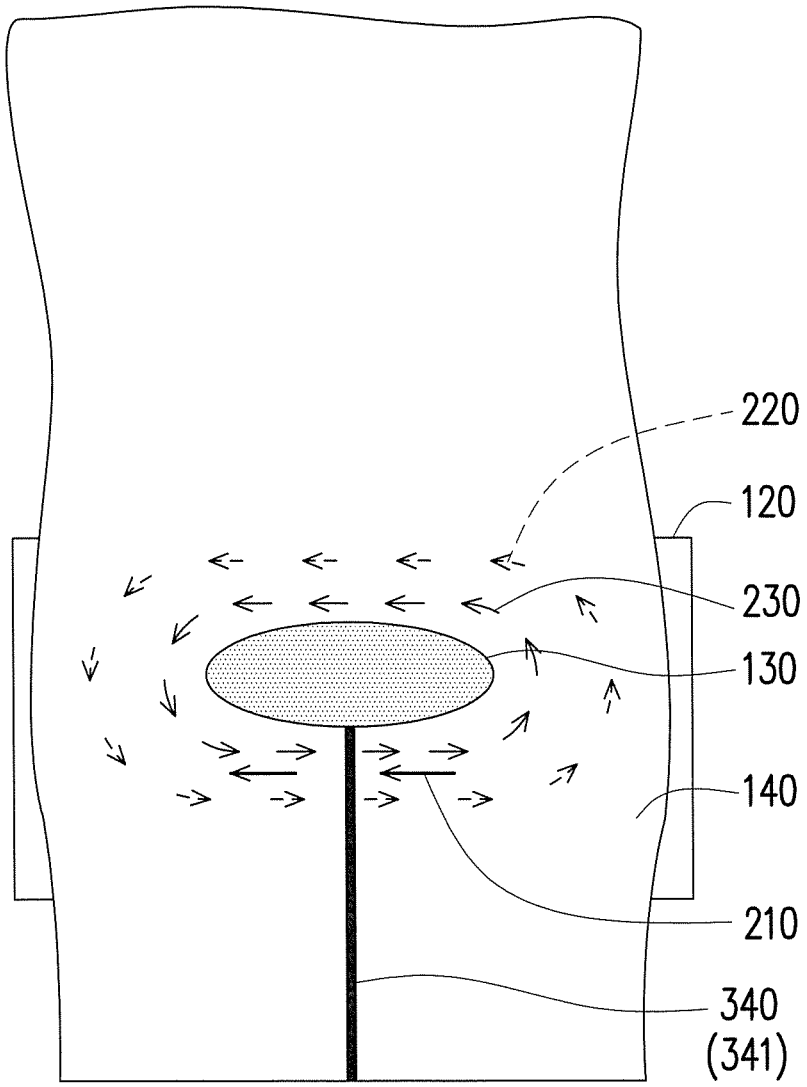
FIG. 4 is a partial schematic diagram showing the electronic device in FIG. 3.

In detail, the insulation structure 340 includes an insulation wire 341. The insulation wire 341 is perpendicular to the first side SD31. A first end of the insulation wire 341 intersects with the first side SD31, and a second end of the insulation wire 341 is close to the second antenna element 130. FIG. 4 is a partial schematic diagram showing the electronic device in FIG. 3. As shown in FIG. 4, the conductive housing 310 generates the first current 230 in response to the operation of the second antenna element 130. The conductive housing 310 also generates the induction current 210 in the alternating magnetic field generated by the first antenna element 120.

Furthermore, under the block of the insulation structure 340, the induction current 210 is converted to the second current 220 whose direction is the same as that of the first current 230. Thus, the second current 220 helps increasing the magnetic flux of the second antenna element 130, and reduces the affection from the conductive element 150 and the conductive housing 310 on the second antenna element 130. Other components in FIG. 3 are illustrated in the previous embodiment, which is omitted herein.

In sum, the conductive housing generates the first current in response to the operation of the second antenna element. The insulation structure penetrates through the conductive housing, and extends from at least one side of the conductive housing to the second antenna element. Consequently, under the block of the insulation structure, the induction current generated in the conductive housing in response to the operation of the first antenna element is converted to the second current whose direction is the same as that of the first current. The second current helps increasing the magnetic flux of the second antenna element, and further reduces the affection from the conductive element and the conductive housing on the second antenna element.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An electronic device, comprising:

a conductive housing;

a first antenna element disposed in the conductive housing;

a second antenna element disposed at an external surface of the conductive housing, wherein the conductive housing is located between the first antenna element and the second antenna element, an orthogonal projection of the first antenna element on the conductive housing is overlapped with an orthogonal projection of the second antenna element on the conductive housing, and the conductive housing generates first current in response to the operation of the second antenna element; and an insulation structure penetrating through the conductive housing and extending from at least one side of the conductive housing to the second antenna element, wherein the conductive housing generates induction current in response to the operation of the first antenna element, the induction current is unable to flow through the insulation structure to make the conductive housing generate second current, and a direction of the first current is the same as a direction of the second current.

2. The electronic device according to claim 1, wherein the electronic device further includes a conductive element, and the conductive element covers the second antenna element.

3. The electronic device according to claim 2, wherein the conductive element is a metal nameplate.

4. The electronic device according to claim 1, wherein the insulation structure is T-shaped or straight-line-shaped.

5. The electronic device according to claim 1, wherein the at least one side of the conductive housing includes a first side and a second side, and the insulation structure includes:

a first insulation element extending from the first side to the second side and intersecting with the first side and the second side; and a second insulation element perpendicular with the first insulation element, wherein a first end of the second insulation element is connected to the first insulation element, and a second end of the second insulation element is close to the second antenna element.

6. The electronic device according to claim 5, wherein the first side is opposite to the second side.

7. The electronic device according to claim 1, wherein the at least one side of the conductive housing includes a first side, the insulation structure includes an insulation element, the insulation element is perpendicular to the first side, a first end of the insulation element intersects with the first side, and a second end of the insulation element is close to the second antenna element.

8. The electronic device according to claim 1, wherein the first antenna element is a coil antenna.

9. The electronic device according to claim 1, wherein the second antenna element is a near-field communication (NFC) antenna.

* * * * *